US006222433B1

(12) United States Patent
Ramakrishnan et al.

(10) Patent No.: US 6,222,433 B1
(45) Date of Patent: Apr. 24, 2001

(54) CIRCUIT BREAKER THERMAL MAGNETIC TRIP UNIT

(75) Inventors: Bhaskar T. Ramakrishnan, Louisville, KY (US); Roger Castonguay, Terryville, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/630,229

(22) Filed: Aug. 1, 2000

Related U.S. Application Data

(62) Division of application No. 09/501,425, filed on Feb. 10, 2000.

(51) Int. Cl.[7] ..... H01H 77/00; H01H 83/00

(52) U.S. Cl. ..... 335/17; 200/308; 335/172; 335/35

(58) Field of Search ..... 335/17, 18, 23–42, 335/167–176; 200/308; 361/42–50

(56) References Cited

U.S. PATENT DOCUMENTS

| | | | | |
|---|---|---|---|---|
| 2,821,596 | | 1/1958 | Bires, Jr. et al. . | |
| 3,353,128 | | 11/1967 | Gauthier . | |
| 3,596,219 | * | 7/1971 | Erickson et al. | 335/17 |
| 4,166,989 | * | 9/1979 | Castonguay et al. | 200/308 |
| 4,301,342 | * | 11/1981 | Castonguay et al. | 335/17 |
| 4,382,270 | * | 5/1983 | Davidson et al. | 361/44 |
| 4,679,018 | | 7/1987 | McKee et al. . | |
| 5,003,139 | * | 3/1991 | Edds et al. | 200/400 |
| 6,054,912 | | 4/2000 | Kaneko et al. . | |

FOREIGN PATENT DOCUMENTS 6-20585 1/1994 (JP) .

* cited by examiner

*Primary Examiner*—Lincoln Donovan
(74) *Attorney, Agent, or Firm*—Cantor Colburn LLP; Carl B. Horton

(57) ABSTRACT

A thermal-magnetic trip unit, suitable for use in a circuit breaker, for eliminating the requirement for latching surfaces while still providing the additional force and motion required to trip the breaker during a short circuit or an overcurrent trip event. The trip unit comprises a link that is biased based on the position of a trip bar. A spring biases the link in a first direction when the trip unit is in a reset condition and biases the link in a second direction when the trip bar is rotated about a pivot point. A trip unit further including an improved indication-of-trip system comprising a two-piece trip bar mechanism and flag system is described to discriminate between overcurrent and short circuit faults. In this embodiment of the invention, visual confirmation of the cause of the trip is provided. The case of the circuit breaker includes a window disposed therein in a location conducive to a user viewing an identification flag thus enabling the rapid determination of the type of trip which has occurred. To identify a trip caused by an overcurrent condition, a first flag is employed. To identify a trip caused by a short circuit condition, a second flag is employed. If an overcurrent event occurs then the first slide of the two piece trip bar mechanism moves to expose the first flag. If a short circuit event occurs, only the second slide of the two-piece trip bar system moves to expose the second flag.

6 Claims, 5 Drawing Sheets

CIRCUIT BREAKER THERMAL MAGNETIC TRIP UNIT

CROSS-REFERENCE TO RELATED APPLICATIONS

This application is a divisional application of U.S. application Ser. No. 09/501,425 filed Feb. 10, 2000, which is hereby incorporated by reference in its entirety.

BACKGROUND OF THE INVENTION

The present invention relates generally to circuit breakers and more particularly to a circuit breaker employing a thermal-magnetic trip unit having an over centering mechanism for unlatching the circuit breaker operating mechanism and a trip flag system that discriminates between a short circuit trip and an overcurrent trip.

Circuit breakers typically provide protection against persistent overcurrent and against very high currents produced by short circuits. This type of protection is provided in many circuit breakers by a thermal-magnetic trip unit having a thermal trip portion, which trips the circuit breaker on persistent overcurrent conditions, and a magnetic trip portion, which trips the circuit breaker on short-circuit conditions.

In order to trip the circuit breaker, the thermal magnetic trip unit must activate an operating mechanism. Once activated, the operating mechanism separates a pair of main contacts to stop the flow of current in the protected circuit. Conventional trip units act directly upon the operating mechanism to activate the operating mechanism. In current thermal-magnetic trip unit designs, the thermal trip portion includes a bimetallic strip (bimetal), which bends at a predetermined temperature. The magnetic trip portion includes an anvil disposed about a current carrying strap and a lever disposed near the anvil, which is drawn towards the anvil when high, short-circuit currents pass through the current carrying strap. The force created by the bimetal or lever, and the distance that they travel, may be insufficient to directly trip the operating mechanism. A conventional way to solve this problem is to use a latch system as a supplemental source of energy. However, the drawback of a latch system is the use of latching surfaces, which degenerate over repeated use.

Further, a circuit breaker having a thermal-magnetic trip unit can be tripped by three events, namely: overcurrent, short circuit and ground fault. It is important to know the cause due to which a breaker has tripped. Distinguishing the reasons for tripping allows the user to determine if the breaker can be reset immediately, as in the case of an overcurrent, or only after careful inspection of the circuitry, as in the case of a short circuit or ground fault.

Circuit breaker trip mechanisms of the prior art have solved this problem by the use of flags, which are visible through windows disposed in the case of the circuit breaker. In such trip mechanisms, a flag appears in one window upon the occurrence of an overcurrent condition, while another flag appears in another window upon the occurrence of a short-circuit condition. This solution works well for trip units having an inactive bimetal. That is, for trip units where the bimetal does not carry electrical current, but is attached to a current-carrying strap. However, this solution can provide indeterminate indications when it is used with a trip unit having an active bimetal. That is, when it is used with a trip unit where the bimetal carries electrical current. When such an active bimetal is used, it is possible during a short circuit event that, in addition to the magnetic trip portion, the bimetal also moves to expose the overcurrent flag, thereby leading to both the short-circuit and overcurrent flags being shown thus providing an indeterminate indication to the user.

SUMMARY OF INVENTION

In an exemplary embodiment of the present invention, a circuit breaker trip mechanism includes an over centering spring tripping linkage. The trip unit consists of a trip bar having a first leg and a second leg. The trip bar is rotatably mounted within the case about a first pivot where the first leg is adjacent to a bimetal mounted within the circuit breaker trip mechanism. A link, having a third leg and a fourth leg, is rotatably mounted within the case about a second pivot. The second leg is pivotally engaged to the third leg of the link by a moveable pin which slides in a slot in the trip bar. The fourth leg of the link is pivotally engaged to a slide by a moveable pin. A slide projection extending outward from the slide is disposed between the first end and the second end of the slide. Further, the link is biased in a first direction about second pivot when the trip unit is in a reset condition and biased in a second direction about pivot when the trip bar is rotated about first pivot thereby urging the slide to interact with the trip lever of the circuit breaker operating mechanism.

In a further exemplary embodiment of the present, an improved indication-of-trip system is employed comprising a two-piece trip bar mechanism. In this embodiment of the invention, visual confirmation of the cause of the trip is provided. This embodiment includes a second trip bar having a fifth and sixth leg. The second trip bar is rotatably mounted within the case about a third pivot. A second link, having a seventh leg and an eighth leg, is rotatably mounted within the case about a fourth pivot. The sixth leg is pivotally engaged to the seventh leg of the second link by a moveable pin. The eighth leg of the second link is pivotally engaged to a second slide by a moveable pin. A slide projection extending outward from the second slide is disposed between the third end and the fourth end of the second slide. Further, the second link is biased in a first direction about the fourth pivot when the trip unit is in a reset condition and biased in a second direction about the fourth pivot when the second trip bar is rotated about the third pivot thereby urging the second slide to interact with the trip lever of the circuit breaker operating mechanism.

The circuit breaker casein this embodiment of the invention includes a window disposed in the case in a location conducive to a user viewing a position indicator thus enabling the rapid determination of the type of trip that has occurred. To identify a trip caused by an overcurrent condition, an overcurrent indicator is employed with the first trip bar whereby the indicator senses the bimetallic force applied on the heat sensitive bimetal. To identify a trip caused by a short circuit condition, a short circuit indicator is employed with the second trip bar whereby the indicator senses the magnetic force applied to the improved indicator of trip bar system.

DESCRIPTION OF THE PREFERRED EMBODIMENT

Figure 1:
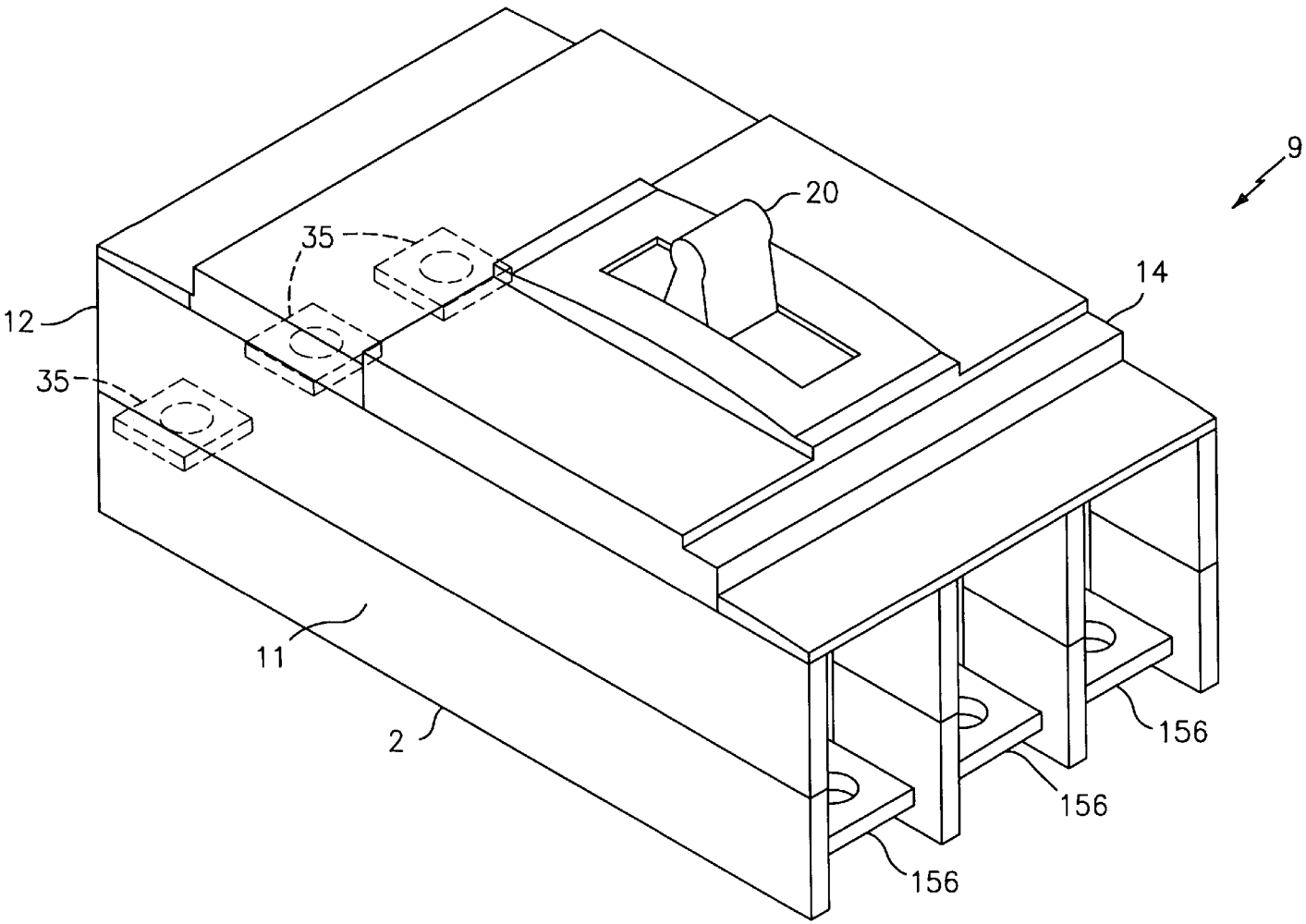
FIG. 1 is a perspective view of a circuit breaker.

Referring to FIG. 1, an embodiment of a molded case circuit breaker 9 is generally shown. Circuit breakers of this type have an insulated case 11 and a mid-cover 12 that house the components of the circuit breaker 9. A handle 20 extending through a cover 14 gives the operator the ability to turn the circuit breaker 9 "on" to energize a protected circuit (shown on FIG. 3), turn the circuit breaker "off" to disconnect the protected circuit (not shown), or "reset" the circuit breaker after a fault (not shown). When the circuit breaker is "on" a pair of electrical contacts 142 and 162 are closed thereby maintaining current flow through the circuit breaker 9. A plurality of straps 156 and 35 also extend through the case 11 for connecting the circuit breaker 9 to the line and load conductors of the protected circuit. The circuit breaker 9 in FIG. 1 shows a typical three phase configuration, however, the present invention is not limited to this configuration but may be applied to other configurations, such as one, two or four phase circuit breakers.

Figure 2:
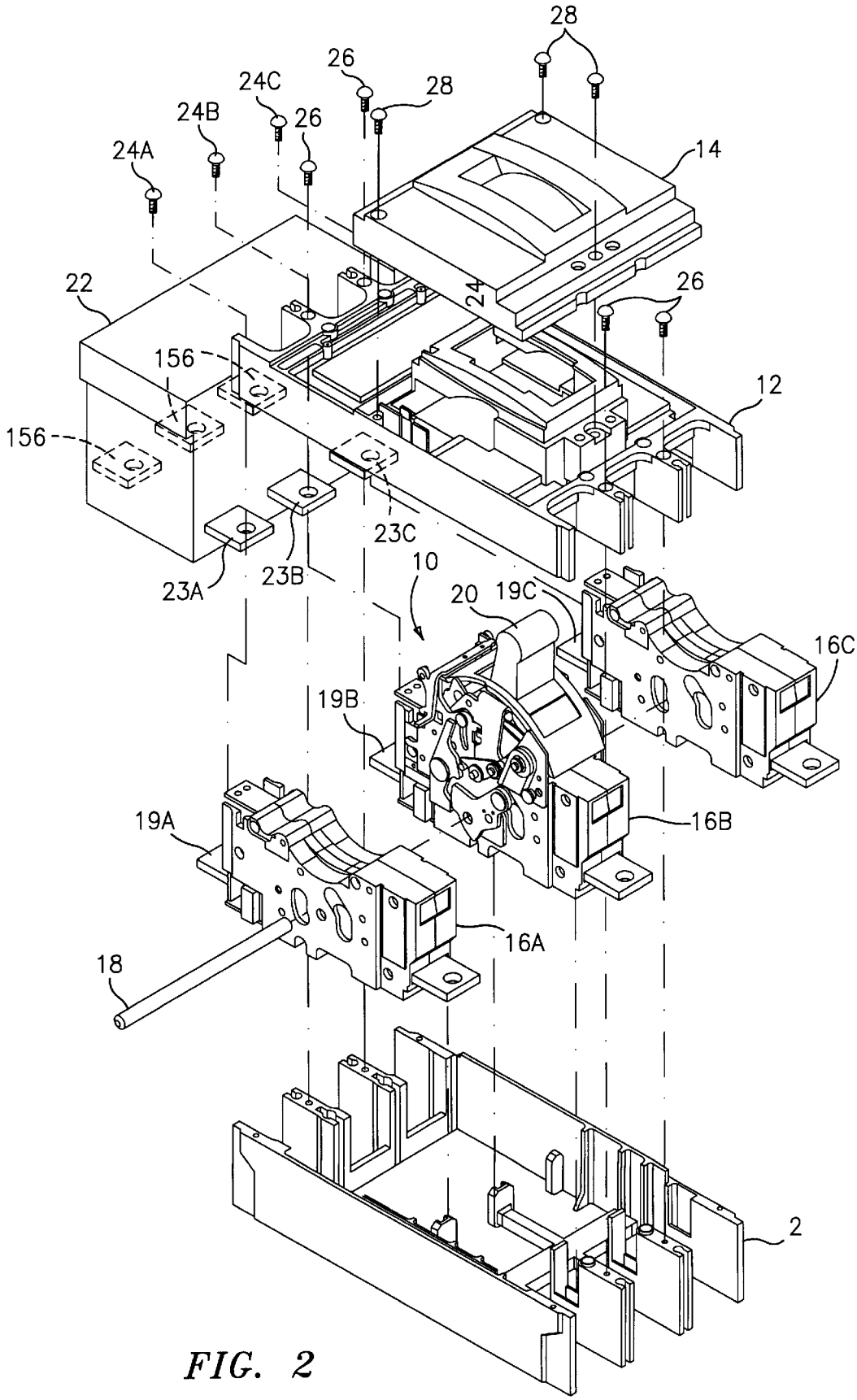
FIG. 2 is an exploded view of the circuit breaker of FIG. 1.

Referring to FIG. 2, the handle 20 is attached to a circuit breaker operating mechanism 10. The circuit breaker operating mechanism 10 is coupled with a center cassette 16B and is connected with outer cassettes 16A and 16C by a drive pin 18. The cassettes 16A, 16B, and 16C along with the circuit breaker operating mechanism 10 are assembled into the base 2 and retained therein by the mid-cover 12. The mid-cover 12 is connected to the base by any convenient means, such as screws 26, snap-fit (not shown) or adhesive bonding (not shown). A cover 14 is attached to the mid-cover 12 by screws 28.

A thermal-magnetic trip unit 22 enclosed within case 11 having straps 23A, 23B, and 23C preferably attaching to the cassette straps 19A, 19B, and 19C with screws 24A, 24B, and 24C. Even though screws are shown herein for connecting the trip unit straps 23 to the cassette straps 19, other methods commonly used in circuit breaker manufacture are contemplated, such as brazing. The trip unit 22 is assembled into the base 2 along with the cassettes 16. Straps 23A, 23B, and 23C conduct current from the power source to the protected circuit.

Figure 3:
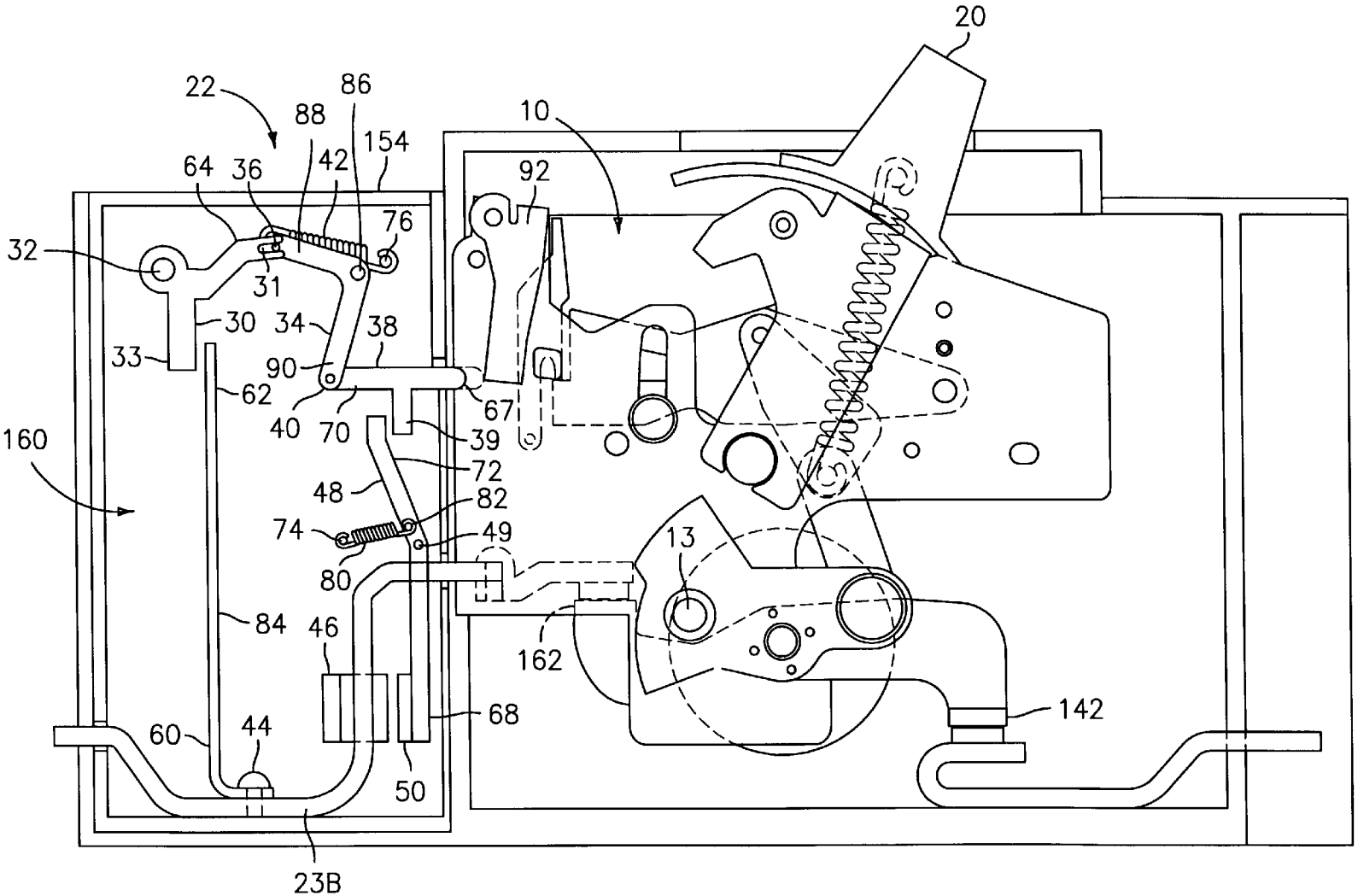
FIG. 3 is an illustration of the circuit breaker of FIG. 1 employing the spring trip unit.

The internal operating mechanism 160 of the trip unit 22 is shown in FIG. 3. The trip unit 22 consists of a trip bar (first trip bar) 30 having a first leg 33 and a second leg 64. The trip bar 30 is rotatably mounted within the case 11 about a first pivot 32. Link (first link) 34 is rotatably mounted within the case 11 about a second pivot 86. Link 34 includes a third leg 88 and a fourth leg 90, both extending from second pivot 86. The second leg 64 of the trip bar 30 is pivotally engaged to the third leg 88 of link 34, for example by a moveable pin 36 which slides in a slot 31 in the trip bar 30. A slide 38 has a first end 70 and a second end 67. The fourth leg 90 of link 34 is pivotally engaged to the first end 70 of the slide (first slide) 38, for example by a moveable pin 40. A slide projection 39 extending outward from slide 38 is disposed between the first end 70 and the second end 67 of the slide 38.

Further, link 34 is biased in a first direction about pivot 86 when the trip unit is in a reset condition and biased in a second direction about second pivot 86 when the trip bar 30 is rotated about first pivot 32 thereby urging the slide 38 to interact with the trip lever 92 of the circuit breaker operating mechanism 10. A first spring 42 having moveable and fixed ends and preferably connecting between a moveable pin 36 and a fixed pin 76 attached to the case 11. The moveable end of the first spring 42 is attached to the third leg 88. First spring 42 as shown in FIG. 3 is arranged to bias the slide 38 away from the trip lever 92. The ends of the first spring 42 are pivoted with respect to first pivot 32, such that, it initially provides a counter-clockwise moment on the trip bar 30 to prevent nuisance tripping.

A heat sensitive strip, for example a bimetal, 84, having a first end 60 and a second end 62, is attached at the first end 60 to the strap 23B by a screw 44. While this attachment is shown as a screw, any process commonly used in circuit breaker manufacturing can be used, such as brazing or welding. The second end 62 of the bi-metal 84 is adjacent to the first leg 33 of the trip bar 30. While only one bimetal is shown here for clarity, a corresponding bimetal would be attached to the adjoining straps 23A and 23C.

A lever 48 having a first end 68 and a second end 72 is mounted within the case 11 and pivots about a pin 49. The lever 48 is made of a ferrous material. Preferably, a ferrous plate 50 is mounted on the first end 68 of the lever 48. An anvil 46, preferably U-shaped, is positioned around the strap 23B adjacent to the first end 68 of the lever 48. The anvil 46 generates a magnetic field in proportion to the current level. The second end 72 of the lever 48 is adjacent the slide projection 39. A second spring 80 connects between a pin 74 connected to the case 11 and a pin 82 located on the lever 48. Second spring 80 is arranged to bias the lever 48 away from the slide projection 39 as shown in FIG. 3.

When an overcurrent condition occurs, the strap 23B generates heat that increases the temperature of the bimetal 84. If the temperature of the bimetal 84 increases sufficiently, due to the current draw exceeding a predefined current level, the second end 62 of the bimetal 84 deflects from an initial position thereby engaging the trip bar 30. The trip bar 30 rotates in the clockwise direction in response to the bimetal force rotatably engaging link 34. Link 34 rotates in a counter-clockwise direction about second point 86 pushing the slide 38 from the reset position as shown in FIG. 3 to the released position towards trip lever 92 (the released position is shown in phantom lines). Once the trip bar 30 rotates to a preset position, the first spring 42 changes with respect to first pivot 32, providing a moment that rotates the trip bar 30 in the clockwise direction. Thus, after reaching a preset position, the first spring 42 takes over from the bimetal 84 and provides the required force and motion so that the slide 38 can engage the trip lever 92 thereby tripping the mechanism 10. In link 34, the ratio between the lengths of third and fourth legs 88 and 90 provides for the magnification of the linear motion of the slide 38 relative to the movement of the trip bar 30 due to the force applied by the bimetal 84. Thus, the linear movement of the slide 38 will generally be greater than the movement of the trip bar 30.

When a short circuit condition occurs, a magnetic field in the anvil 46 is generated proportional to the current passing through strap 23B. When the magnetic force attracting the ferrous plate 50 of the lever 48 is greater than a predetermined level, the first end 68 of the lever 48 is attracted to the anvil 46 causing the second end 72 to engage the slide projection 39 thereby moving the slide 38 to the released position towards trip lever 92 (the released position is shown in phantom lines). Once the trip bar 30 rotates to a preset position, the first spring 42 changes with respect to first pivot 32, providing a moment that rotates the trip bar 30 in the clockwise direction.

It is noted that when an active bimetal is used, it is very possible during a short circuit event that in addition to the lever 48 engaging the slide projection 39 in response to the magnetic force generated by the anvil 46, the bimetal 84 also engages the trip bar 30.

Figure 4:
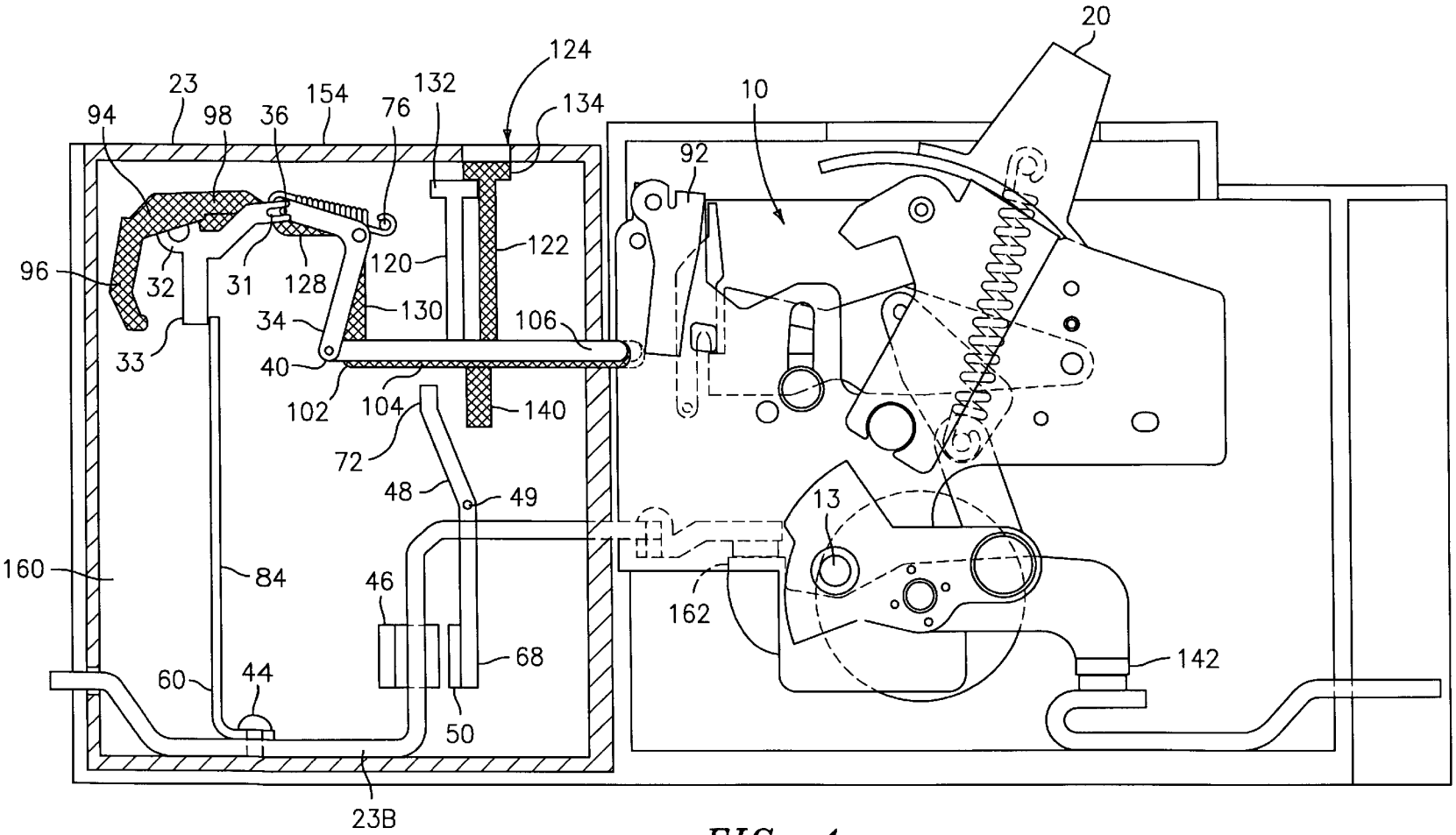
FIG. 4 is an illustration of the indication of trip two-piece trip bar system.
Figure 5:
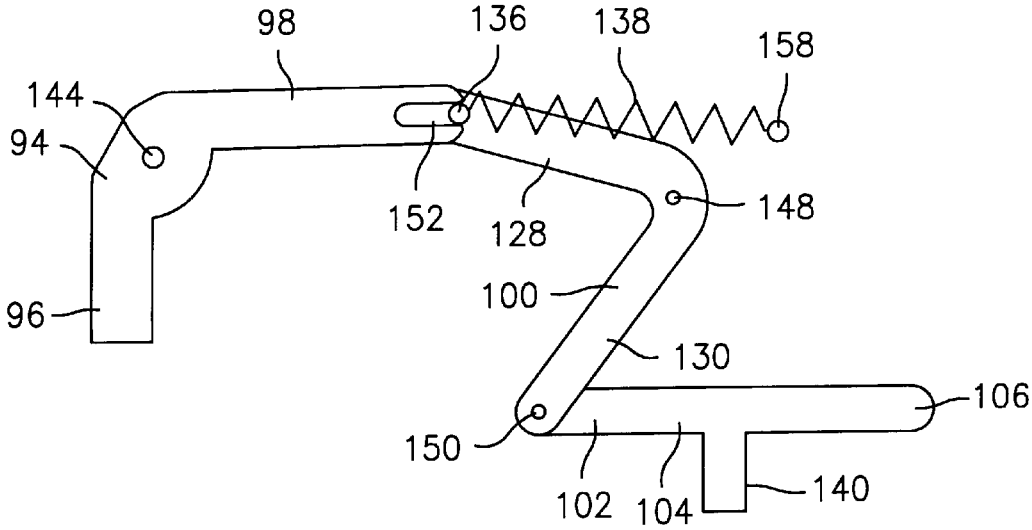
FIG. 5 is an enlarged view of the second trip bar linkage of FIG. 4.
Figure 6:
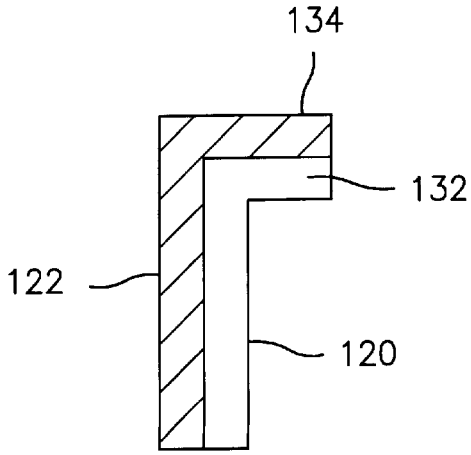
FIG. 6 is an enlarged view of the position indicator and flag system of FIG. 4.

In a further exemplary embodiment of the present invention, an improved indication-of-trip system is employed comprising a two piece trip bar mechanism. In this embodiment of the invention, visual confirmation of the cause of the trip is provided. This system is shown in FIGS. 4, 5 and 6. The first trip bar mechanism includes the trip bar 30, the link 34, and the slide 38 as described hereinabove. The second trip bar mechanism includes a second trip bar 94, a second link 100 and a second slide 104. The first trip bar mechanism senses the bimetallic force and the second trip bar senses the magnetic force.

The internal operating mechanism 160 of the improved indication-of-trip system used in trip unit 22 is shown in FIG. 4. The trip unit 22 consists of a trip bar 30 having a first leg 33 and a second leg 64. The trip bar 30 is rotatably mounted within the case 11 about a first pivot 32. Link 34 is rotatably mounted within the case 11 about a second pivot 86. Link 34 includes a third leg 88 and a fourth leg 90, both extending from second pivot 86. The second leg 64 of the trip bar 30 is pivotally engaged to the third leg 88 of link 34, for example by a moveable pin 36 which slides in a slot 31 in the trip bar 30. A slide 38 has a first end 70 and a second end 67. The fourth leg 90 of link 34 is pivotally engaged to the first end 70 of the slide 38, for example by a moveable pin 40.

Further, link 34 is biased in a first direction about pivot 86 when the trip unit is in a reset condition and biased in a second direction about pivot 86 when the trip bar 30 is rotated about first pivot 32 thereby urging the slide 38 to interact with the trip lever 92 of the circuit breaker operating mechanism 10. The first spring 42, having moveable and fixed ends and preferably connecting between a moveable pin 36 and a fixed pin 76 attached to the case 11. The moveable end of the first spring 42 is attached to the third leg 88. First spring 42 as shown in FIG. 3 is arranged to bias the slide 38 away from the trip lever 92. The ends of the first spring 42 are pivoted with respect to first pivot 32, such that, it initially provides a counter-clockwise moment on the trip bar 30 to prevent nuisance tripping.

In the second trip bar mechanism, the trip unit 22 also consists of a second trip bar 94 having a fifth leg 96 and a sixth leg 98. The second trip bar 94 is rotatably mounted within the case 11 about a third pivot 144. Second link 100 is rotatably mounted within the case 11 about a fourth pivot 148. It is within the scope of this embodiment of the present invention and apparent to those skilled in the art that both trip bar 30 and second trip bar 94 could be modified to rotate about first pivot 32, independent of each other. Second link 100 includes a seventh leg 128 and an eighth leg 130, both extending from fourth pivot 148. It is within the scope of this embodiment of the present invention and apparent to those skilled in the art that both link 34 and second link 100 could be modified to rotate about second pivot point 86, independent of each other. The sixth leg 98 of the trip bar 94 is pivotally engaged to the seventh leg 128 of second link 100, for example by a moveable pin 136 which slides in a slot 152 of the second trip bar 94. Second slide 104 has a third end 102 and a fourth end 106. The eighth leg 130 of second link 100 is pivotally engaged to the third end 102 of the second slide 104, for example by a moveable pin 150. A slide projection 140 extending outward from second slide 104 is disposed between the third end 102 and the fourth end 106 of the second slide 104.

Further, second link 100 is biased in a first direction about fourth pivot 148 when the trip unit is in a reset condition and biased in a second direction about fourth pivot 148 when the trip bar 94 is rotated about third pivot 144 thereby urging the second slide 104 to interact with the trip lever 92 of the circuit breaker operating mechanism 10. A third spring 138 having moveable and fixed ends and preferable connecting between the moveable pin 136 and a fixed pin 158 attached to the case 11. The moveable end of the third spring 138 is attached to the seventh leg 128. The third spring 138 as shown in FIG. 4 is arranged to bias the second slide 104 away from the trip lever 92. The ends of the spring are pivoted with respect to third pivot 144, such that, it initially provides a counter-clockwise moment on the second trip bar 94 to prevent nuisance tripping.

A heat sensitive strip, for example a bimetal, 84, having a first end 60 and a second end 62, is attached at the first end 60 to the strap 23B by a screw 44. While this attachment is shown as a screw, any process commonly used in circuit breaker manufacturing can be used, such as brazing or welding. The second end 62 of the bimetal 84 is adjacent to the first leg 33 of the trip bar 30. While only one bimetal is shown here for clarity, a corresponding bimetal would be attached to the adjoining straps 23A and 23C.

A lever 48 having a first end 68 and a second end 72 is mounted within the case 11 and pivots about a pin 49. The lever 48 is made of a ferrous material. Preferably, a ferrous plate 50 is mounted on the first end 68 of the lever 48. An anvil 46, preferably U-shaped, is positioned around the strap 23B adjacent to the first end 68 of the lever 48. The anvil 46 generates a magnetic field in proportion to the current level. The second end 72 of the lever 48 is adjacent the slide projection 140. A second spring 80 connects between a pin 74 connected to the case 11 and a pin 82 located on the lever 48. Second spring 80 is arranged to bias the lever 48 away from the slide projection 140. Although the magnetic portion of the trip unit, as described hereinabove, engages a slide projection 140 on the second slide 104, it is apparent to one skilled in the art that the magnetic portion can be modified to engage the third leg 96 of the second trip bar 94.

When an overcurrent condition occurs, the strap 23B generates heat that increases the temperature of the bimetal 84. If the temperature of the bimetal 84 increases sufficiently due to the current draw exceeding a predefined current level, the second end 62 of the bimetal 84 deflects from an initial position thereby engaging the trip bar 30. The deflection is proportional to the current level. The trip bar 30 rotates in the clockwise direction in response to the bimetal force rotatably engaging link 34. Link 34 rotates in a counter-clockwise direction about point 86 pushing the slide 38 to the released position towards trip lever 92 (the released position is shown in phantom lines). Once the trip bar 30 rotates to a preset position, the first spring 42 changes with respect to first pivot 32, providing a moment that rotates the trip bar 30 in the clockwise direction. Thus, after reaching a preset position, the first spring 42 takes over from the bimetal 84 and provides the required force and motion so that the slide 38 can engage the trip lever 92 thereby tripping the mechanism 10. In link 34, the ratio between the lengths of third and fourth legs 88 and 90 provides for the magnification of the linear motion of the slide 38 relative to the movement of the trip bar 30 due to the force applied by the bimetal 84. Thus, the linear movement of the slide 38 will generally be greater than the movement of the trip bar 30.

When a short circuit condition occurs, a magnetic field in the anvil 46 is generated proportional the current passing through strap 23B. When the magnetic force attracting the ferrous plate 50 of the lever 48 is greater than a predetermined level, the first end 68 of the lever 48 is attracted to the anvil 46 causing the second end 72 to engage the slide projection 140 thereby moving the second slide 104 to the released position towards trip lever 92 (the released position is shown in phantom lines). Once the trip bar 94 rotates to a preset position, a third spring 138 changes with respect to third pivot 144, providing a moment that rotates the trip bar 94 in the clockwise direction. Thus, after reaching a preset position, third spring 138 takes over from the lever 48 and moves the second slide 104 engaging the trip lever 92 and thereby tripping the mechanism 10. In the second link 100, the ratio between the lengths of the seventh and eighth legs 128 and 130 provides for the magnification of the linear motion of the slide 38 relative to the movement of the trip bar 94 due to the force applied by the lever 48. Thus, the linear movement of the slide 38 will generally be greater than the movement of the trip bar 94.

The case 11 in this embodiment of the invention includes a window 124 disposed therein in a location conducive to a user viewing an identification flag on the end of a position indicator thus enabling the rapid determination of the type of trip that has occurred. To identify a trip caused by an overcurrent condition, a position indicator (overcurrent indicator) 120 is employed. The overcurrent indicator 120 carries the first flag (overcurrent flag) 132 and senses the bimetallic force applied on the bimetal which is heat sensitive. To identify a trip caused by a short circuit condition, a position indicator (short circuit indicator) 122 is employed. The short circuit indicator 122 caries the second flag (short circuit flag) 134 and senses the magnetic force applied to the improved indicator of trip bar system. The overcurrent indicator 120 and flag 132 are viewable through the window 124 for indicating a tripped position which occurs when the current path is interrupted in response to a trip event caused by overheating. The overcurrent indicator 120 is located some distance between the first end 70 and second end 67 of the first slide 38. The short circuit indicator 122 and second flag 134 are viewable through the window 124 for indicating a tripped position which occurs when the current path is interrupted in response to a short circuit. The short circuit indicator 122 is located some distance between the third end 102 and fourth end 106 of the second slide 104.

If an overcurrent event occurs, then the first slide 38 moves to expose the first flag 132 through the window 124 of the case 11. If a short circuit event occurs, only the second slide 104 moves to expose the second flag 134 through the window 124 of the case 11.

When an active bimetal is used, it is very possible during a short circuit event that in addition to the lever 104 engaging the slide projection 128 in response to the magnetic force generated by the anvil, the bimetal 84 also engages the trip bar 30. In this instance the first flag 132 would be exposed thereby leading to a false indication as to the cause of the trip. In order to address this situation, in this embodiment of the invention, the second flag 134 is located at a plane higher that the first flag 132. Therefore, as shown in FIG. 5, the overcurrent indicator 120 is shorter in length than the short circuit indicator 122. Also, the second flag 134 has an extended top surface which completely overlaps the first flag 132. Therefore, during a short circuit event, only the second flag 134 is seen from the window 124 thereby preventing a false indication of what caused the trip event.

It is also within the scope of the present invention and apparent to one skilled in the art that a position indicator 120 and 122 may also be utilized on the slide 38 to indicate a trip caused by overheating or a short circuit.

The advantage of the over centering spring tripping mechanism is that it eliminates the requirement for latching surfaces which degenerate with repeated use. In addition, the mechanism provides the additional force and motion required to trip a circuit breaker.

Further, the two-piece trip bar and position indicator flag system discriminates between a trip caused by over heating and a trip caused by a short circuit. In addition, the position indicator and flag system does not mislead the user when a short circuit event has occurred. When a short circuit event has occurred, only the second flag 134, and not the first flag 132, is visible from the window 124 of the case 11.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but rather that the invention will include all embodiments falling within the scope of the appended claims.

What is claimed is:

1. A trip unit for interacting with a circuit breaker operating unit, said trip unit comprising:

a case having a window disposed therein;

a first slide configured to activate the operating unit in response to an overcurrent condition;

an overcurrent indicator extending from said first slide, said overcurrent indicator being visible through said window when the operating unit is activated in response to an overcurrent condition;

a second slide arranged to activate the operating unit in response to a short-circuit condition; and a short-circuit indicator extending from said second slide, said short-circuit indicator being visible through said window when the operating unit is activated in response to a short-circuit condition.

2. The trip unit of claim 1, wherein said overcurrent indicator extends a first distance from said first slide, and said short-circuit indicator extends a second distance from said second slide, said first distance being less than said second distance.

3. The trip unit of claim 1 wherein said overcurrent indicator includes a first flag extending from an end of said overcurrent indicator, and said short circuit indicator includes a second flag extending from an end of said short circuit indicator, said second flag extending above said first flag for hiding said first flag from view through said window when the operating mechanism is activated in response to a short-circuit condition.

4. A circuit breaker comprising:

a case having a window disposed therein;

a pair of electrical contacts disposed in said case;

an operating unit disposed in said case, said operating unit having a trip lever disposed therein, said operating unit being arranged to separate said pair of electrical contacts upon movement of said trip lever; and, a trip unit disposed in said case, said trip unit including:

a first slide arranged to activate said trip lever in response to an overcurrent condition, an overcurrent indicator extending from said first slide, said overcurrent indicator being visible through said window when said trip lever is activated in response to an overcurrent condition, a second slide arranged to activate said trip lever in response to a short-circuit condition, and a short-circuit indicator extending from said second slide, said short-circuit indicator being visible through said window when said trip lever is activated in response to a short-circuit condition.

5. The circuit breaker of claim 4, wherein said overcurrent indicator extends a first distance from said first slide, and said short-circuit indicator extends a second distance from said second slide, said first distance being less than said second distance.

6. The circuit breaker of claim 5 wherein said overcurrent indicator includes a first flag extending from an end of said overcurrent indicator, and said short circuit indicator includes a second flag extending from an end of said short circuit indicator, said second flag extending above said first flag for hiding said first flag from view through said window when said trip lever is activated in response to a short-circuit condition.

* * * * *